US006889883B2

(12) United States Patent
Nykoluk

(10) Patent No.: US 6,889,883 B2
(45) Date of Patent: May 10, 2005

(54) DRY CD PORT FOR A BACKPACK OR BAG

(75) Inventor: Cory O. Nykoluk, Ballwin, MO (US)

(73) Assignee: Cerf Brothers Bag Company, Earth City, MO (US)

( * ) Notice: Subject to any disclaimer, the term of this patent is extended or adjusted under 35 U.S.C. 154(b) by 24 days.

(21) Appl. No.: 10/353,424

(22) Filed: Jan. 29, 2003

(65) Prior Publication Data

US 2004/0144666 A1 Jul. 29, 2004

(51) Int. Cl.[7] ..... A45C 15/00

(52) U.S. Cl. ..... 224/645; 206/320; 224/654; 224/930

(58) Field of Search ..... 206/320, 811; 224/627, 645, 654, 930; 215/235, 306, 364

(56) References Cited

U.S. PATENT DOCUMENTS 4,457,458 A * 7/1984 Heinol ..... 222/498
5,482,172 A * 1/1996 Braddock ..... 215/235
5,706,940 A * 1/1998 Amarello ..... 206/320
5,706,992 A * 1/1998 Moor ..... 224/657
6,006,915 A * 12/1999 Moor ..... 206/579
6,039,197 A * 3/2000 Braun ..... 215/228
6,041,477 A * 3/2000 Rentsch et al. ..... 16/225
6,042,416 A * 3/2000 Lopes ..... 439/500
6,349,824 B1 * 2/2002 Yamada ..... 206/316.1
6,659,320 B1 * 12/2003 Alves et al. ..... 224/581
6,712,249 B2 * 3/2004 Magnusson et al. ..... 224/576

* cited by examiner

*Primary Examiner*—John A. Ricci
(74) *Attorney, Agent, or Firm*—Polster, Lieder, Woodruff & Lucchesi, L.C.

(57) ABSTRACT

The present invention provides a bag having a closure such that the bag may be substantially closed to the outside environment. The closure comprises a CD port attached to the bag. The CD port comprises a bottom portion comprising two raised portions each defining opposing inner sides, the bottom portion further defining a cutout portion. The CD port further comprises a resilient top portion defining two opposed outer sides having a shape that generally conforms to a shape of the opposed inner sides of the raised portion.

11 Claims, 1 Drawing Sheet

DRY CD PORT FOR A BACKPACK OR BAG

BACKGROUND OF THE INVENTION

In the past, an opening to allow a headphone cable for a radio or recorded music player to exit a bag, backpack or the like has been known. Such openings allowed the user to place the radio or recorded music player within a bag so that the user would not have to separately carry the device and where it would be protected. Such openings allowed a headphone cord to exit the bag while without leaving a zipper or other bag or backpack closure partially open. The opening has come to be called a "CD port," although it should be clear to one of ordinary skill in the art that the opening can be used with all types of radios and recorded media devices.

Typical prior art CD ports comprise only a piece of resilient material, such as rubber, with two perpendicular slits therein that form an X. As a result when the bag is exposed to rain, water may easily enter the CD port and potentially damages the radio or recorded media player or other contents of the bag.

SUMMARY OF THE INVENTION

The present invention provides a bag having a closure such that the bag may be substantially closed to the outside environment. The closure comprises a CD port attached to the bag. The CD port comprises a bottom portion comprising two raised portions each defining opposing inner sides, the bottom portion further defining a cutout portion. The CD port further comprises a resilient top portion defining two opposed outer sides having a shape that generally conforms to a shape of the opposed inner sides of the raised portion.

DESCRIPTION OF THE PREFERRED EMBODIMENT

Figure 1:
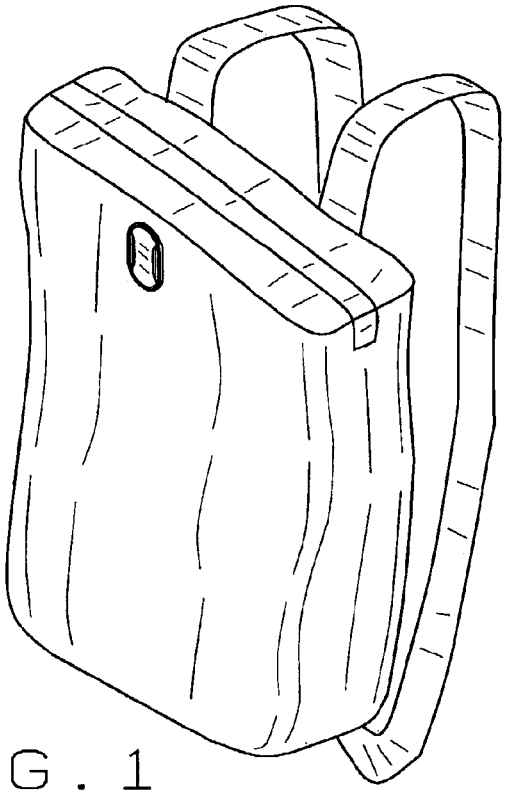
FIG. 1 is a perspective view of a backpack having a CD port according to an embodiment of the present invention.

While the invention is susceptible of embodiment in many different forms, there is shown in the drawings and described in detail preferred embodiments of the invention. It is to be understood that the present disclosure is to be considered only as an example of the principles of the invention. This disclosure is not intended to limit the broad aspect of the invention to the illustrated embodiments. The scope of protection should only be limited by the claims.

Referring to FIG. 1, the present invention comprises a CD port 10 which may be attached to a bag or backpack 12 in order to allow a user to place a radio or recorded music player (not shown) within the bag 12. As used in this patent the terms bag and backpack are used such that the definition of either includes the other.

Figure 2:
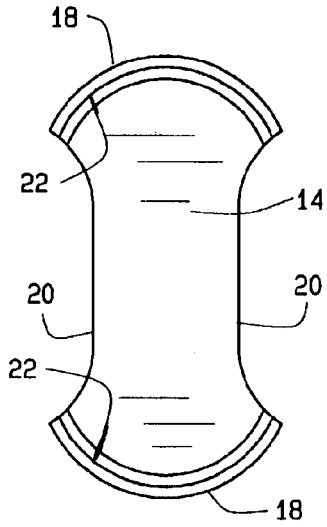
FIG. 2 is a plan view of a top portion of a CD port according to an embodiment of the present invention.
Figure 3:
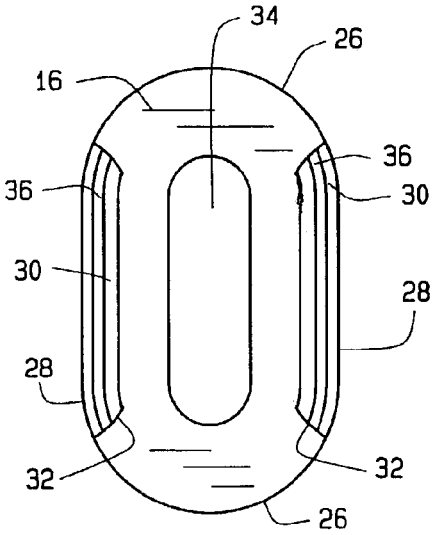
FIG. 3 is a plan view of a bottom portion of a CD port according to an embodiment of the present invention.
Figure 4:
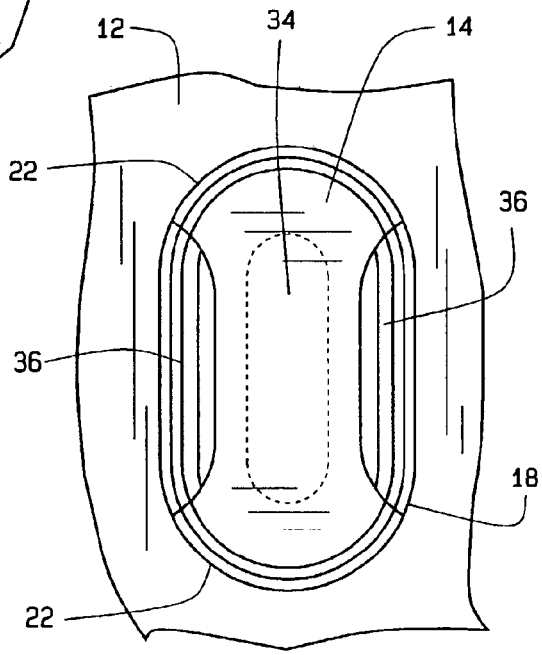
FIG. 4 is a plan view of a top and bottom portion of a CD port sewn to a bag or backpack according to an embodiment of the present invention.

Referring to FIGS. 2–4, the CD port 10 comprises a top portion 14 (FIG. 2) and a bottom portion 16 (FIG. 3). At least the top portion 14 is made from a resilient rubber material and, preferably, the bottom portion 16 is made from the same resilient material. The top portion 14 comprises a piece of material having two arced ends 18 and opposed sides 20. Preferably, the opposed sides 20 are inwardly projecting or arcing opposed sides as shown in FIG. 2. However, the opposed sides 20 could comprise two straight parallel edges such that the top portion 14 generally conforms to the shape of an obround. Moreover, the ends 18 may also be replaced with parallel edges without departing from the scope of the present invention. Additionally, the top portion 20 preferably further comprises stitch grooves 22 along an arc having a smaller radius and same center point as each of the arced ends 18.

The bottom portion 16 comprises two ends 26, which generally conform to the shape of the ends 18 of the top portion 14 and opposed sides 28 which are preferably straight, parallel edges. Adjacent each side 28 are raised portions 30 that allow that have inner edges 32 that generally conform to the shape of the opposed sides 20 of the top portion 14. The bottom portion 16 also defines a cutout portion 34. Finally, the raised portions 30 each define stitch grooves 36.

The bag or backpack 12 defines a hole corresponding to the cutout portion 34 of the bottom portion 16.

In order to assemble the top and bottom portions 14, 16, the top portion 14 is placed between the raised portions 30 of the bottom portion 16. The assembled top and bottom portions 14, 16 are then stitched to the bag or backpack 12 by sewing the CD port 10 to the bag or backpack 12 through the stitch grooves 22, 36 of the top and bottom portions 14, 16. When sewing through the stitch grooves 22 of the top portion 14, stitching also goes through the bottom portion 16 thus attaching both the top portion and the bottom portion 14, 16 to the bag or backpack 12. Alternatively, the CD port 10 may be glued to the bottom portion 16 which is, in turn, glued or sewn to the top portion 14 at points near the ends 18, 26.

The bag or back pack 12 with the CD port 10 thus installed may be used by a holder or wearer by inserting the radio or recorded music player inside the bag or backpack 12 and threading the headphone wire through the cutout portion 34 such that the wire exits the bag through the CD port 10 between the top and bottom portions. This may be accomplished by the user resiliently deforming the top portion 14 away from the bottom portion 16 by pulling the top portion 14 outwardly or by forcing the ends 18 and 26 of the top and bottom portions 14, 16 toward each other such that the top portion 14 and bottom portion 16 resiliently deform in opposite directions, thereby allowing clearance for the wire to be thread through the cutout portion 34 and under the top portion 14. In the present invention, when the top portion 14 resiliently deforms back to the position shown in FIG. 4, the cutout portion is substantially covered and rain cannot easily enter the bag. As a result, the CD port of the present invention provides better protection from the elements than do prior art CD ports.

While the specific embodiments have been illustrated and described, numerous modifications come to mind without significantly departing from the spirit of the invention, and the scope of protection is only limited by the scope of the accompanying claims.

I claim:

1. A bag having a closure such that the bag may be substantially closed to the outside environment comprising:

a CD port attached to the bag comprising:

a bottom portion comprising two raised portions each defining opposing inner sides, the bottom portion further defining a cutout portion;

a resilient top portion defining two opposed outer sides having a shape that generally conforms to a shape of the opposed inner sides of the raised portions of the bottom portion.

2. The bag of claim 1 wherein the CD port is sewn to the bag through portions of a periphery of the bottom and top portions.

3. The bag of claim 1 wherein the top portion and bottom portions each define stitch grooves along at least portions of a periphery thereof.

4. The bag of claim 1 wherein the opposed outer sides of the top portion comprises generally inwardly arcing sides such that when the top portion is placed between the raised portions of the bottom portion, the top portion is generally locked into position therebetween.

5. The bag of claim 1 wherein the periphery of the bottom portion generally corresponds to the shape of an obround.

6. A CD port for attachment to a bag comprising:

a bottom portion comprising two raised portions each defining opposing inner sides, the bottom portion further defining a cutout portion;

a resilient top portion defining two opposed outer sides having a shape that generally conforms to a shape of the opposed inner sides of the raised portions and the resilient top portion is attached to the bottom portion at least at each of the two opposed outer sides.

7. The CD port of claim 6 wherein the periphery of the bottom portion generally corresponds to the shape of an obround.

8. A CD port for attachment to a bag comprising:

a bottom portion comprising two raised portions each defining opposing inner sides, the bottom portion further defining a cutout portion;

a resilient top portion defining two opposed outer sides having a shape that generally conforms to a shape of the opposed inner sides of the raised portions; and wherein the top portion and bottom portions each define stitch grooves along portions of a periphery thereof.

9. The CD port of claim 8 wherein the periphery of the bottom portion generally corresponds to the shape of an obround.

10. A CD port for attachment to a bag comprising:

a bottom portion comprising two raised portions each defining opposing inner sides, the bottom portion further defining a cutout portion;

a resilient top portion defining two opposed outer sides having a shape that generally conforms to a shape of the opposed inner sides of the raised portions; and wherein the opposed outer sides of the top portion comprises generally inwardly arcing sides such that when the top portion is placed between the raised portions of the bottom portion, the top portion is generally locked into position therebetween.

11. The CD port of claim 10 wherein the periphery of the bottom portion generally corresponds to the shape of an obround.

* * * * *

UNITED STATES PATENT AND TRADEMARK OFFICE

CERTIFICATE OF CORRECTION

PATENT NO. : 6,889,883 B2
DATED : May 10, 2005
INVENTOR(S) : Cory O. Nykoluk

It is certified that error appears in the above-identified patent and that said Letters Patent is hereby corrected as shown below:

Title page,
Item [*] Notice, please delete and insert -- Subject to any disclaimer, the term of this patent is extended or adjusted under 35 U.S.C. 154(b) by 115 days --.

Signed and Sealed this

Eighth Day of November, 2005

JON W. DUDAS
*Director of the United States Patent and Trademark Office*